US007656094B2

(12) United States Patent
Gorrell et al.

(10) Patent No.: US 7,656,094 B2
(45) Date of Patent: Feb. 2, 2010

(54) ELECTRON ACCELERATOR FOR ULTRA-SMALL RESONANT STRUCTURES

(75) Inventors: Jonathan Gorrell, Gainesville, FL (US); Mark Davidson, Florahome, FL (US)

(73) Assignee: Virgin Islands Microsystems, Inc., St. Thomas, VI (US)

( * ) Notice: Subject to any disclaimer, the term of this patent is extended or adjusted under 35 U.S.C. 154(b) by 685 days.

(21) Appl. No.: 11/418,294

(22) Filed: May 5, 2006

(65) Prior Publication Data

US 2007/0257208 A1 Nov. 8, 2007

(51) Int. Cl.
*H01J 23/02* (2006.01)

(52) U.S. Cl. ..... 315/5.38; 315/5.43; 315/500

(58) Field of Classification Search ..... 315/5, 315/5.37, 5.38, 5.43, 500, 501, 505; 250/396 R, 250/397, 492.1, 492.21, 494.1
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,297,905 | A | 1/1967 | Rockwell et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |
| 3,560,694 | A | 2/1971 | White |
| 3,571,642 | A | 3/1971 | Westcott |
| 3,586,899 | A | 6/1971 | Fleisher |

(Continued)

FOREIGN PATENT DOCUMENTS

EP 0237559 B1 12/1991

(Continued)

OTHER PUBLICATIONS

U.S. Appl. No. 11/418,082, filed May 5, 2006, Gorrell et al.

(Continued)

*Primary Examiner*—Douglas W Owens
*Assistant Examiner*—Jimmy T Vu
(74) *Attorney, Agent, or Firm*—Davidson Berquist Jackson & Gowdey, LLP

(57) ABSTRACT

An electronic transmitter or receiver employing electromagnetic radiation as a coded signal carrier is described. In the transmitter, the electromagnetic radiation is emitted from ultra-small resonant structures when an electron beam passes proximate the structures. In the receiver, the electron beam passes near ultra-small resonant structures and is altered in path or velocity by the effect of the electromagnetic radiation on structures. The electron beam is accelerated to an appropriate current density without the use of a high power supply. Instead, a sequence of low power levels is supplied to a sequence of anodes in the electron beam path. The electron beam is thereby accelerated to a desired current density appropriate for the transmitter or receiver application without the need for a high-level power source.

21 Claims, 4 Drawing Sheets

U.S. PATENT DOCUMENTS

| | | | | |
|---|---|---|---|---|
| 3,761,828 | A | | 9/1973 | Pollard et al. |
| 3,886,399 | A | | 5/1975 | Symons |
| 3,923,568 | A | | 12/1975 | Bersin |
| 3,989,347 | A | | 11/1976 | Eschler |
| 4,053,845 | A | | 10/1977 | Gould |
| 4,282,436 | A | | 8/1981 | Kapetanakos |
| 4,450,554 | A | | 5/1984 | Steensma et al. |
| 4,453,108 | A | | 6/1984 | Freeman, Jr. |
| 4,482,779 | A | | 11/1984 | Anderson |
| 4,528,659 | A | | 7/1985 | Jones, Jr. |
| 4,589,107 | A | | 5/1986 | Middleton et al. |
| 4,598,397 | A | | 7/1986 | Nelson et al. |
| 4,630,262 | A | | 12/1986 | Callens et al. |
| 4,652,703 | A | | 3/1987 | Lu et al. |
| 4,661,783 | A | | 4/1987 | Gover et al. |
| 4,704,583 | A | | 11/1987 | Gould |
| 4,712,042 | A | | 12/1987 | Hamm |
| 4,713,581 | A | | 12/1987 | Haimson |
| 4,727,550 | A | | 2/1988 | Chang et al. |
| 4,740,963 | A | | 4/1988 | Eckley |
| 4,740,973 | A | | 4/1988 | Madey |
| 4,746,201 | A | | 5/1988 | Gould |
| 4,761,059 | A | | 8/1988 | Yeh et al. |
| 4,782,485 | A | | 11/1988 | Gollub |
| 4,789,945 | A | | 12/1988 | Niijima |
| 4,806,859 | A | | 2/1989 | Hetrick |
| 4,809,271 | A | | 2/1989 | Kondo et al. |
| 4,813,040 | A | | 3/1989 | Futato |
| 4,819,228 | A | | 4/1989 | Baran et al. |
| 4,829,527 | A | | 5/1989 | Wortman et al. |
| 4,838,021 | A | | 6/1989 | Beattie |
| 4,841,538 | A | | 6/1989 | Yanabu et al. |
| 4,864,131 | A | | 9/1989 | Rich et al. |
| 4,866,704 | A | | 9/1989 | Bergman |
| 4,866,732 | A | | 9/1989 | Carey et al. |
| 4,873,715 | A | | 10/1989 | Shibata |
| 4,887,265 | A | | 12/1989 | Felix |
| 4,890,282 | A | | 12/1989 | Lambert et al. |
| 4,898,022 | A | | 2/1990 | Yumoto et al. |
| 4,912,705 | A | | 3/1990 | Paneth et al. |
| 4,932,022 | A | | 6/1990 | Keeney et al. |
| 4,981,371 | A | | 1/1991 | Gurak et al. |
| 5,023,563 | A | | 6/1991 | Harvey et al. |
| 5,036,513 | A | | 7/1991 | Greenblatt |
| 5,065,425 | A | | 11/1991 | Lecomte et al. |
| 5,113,141 | A | | 5/1992 | Swenson |
| 5,121,385 | A | | 6/1992 | Tominaga et al. |
| 5,127,001 | A | | 6/1992 | Steagall et al. |
| 5,128,729 | A | | 7/1992 | Alonas et al. |
| 5,130,985 | A | | 7/1992 | Kondo et al. |
| 5,150,410 | A | | 9/1992 | Bertrand |
| 5,155,726 | A | | 10/1992 | Spinney et al. |
| 5,157,000 | A | | 10/1992 | Elkind et al. |
| 5,163,118 | A | | 11/1992 | Lorenzo et al. |
| 5,185,073 | A | | 2/1993 | Bindra |
| 5,187,591 | A | | 2/1993 | Guy et al. |
| 5,199,918 | A | | 4/1993 | Kumar |
| 5,214,650 | A | | 5/1993 | Renner et al. |
| 5,233,623 | A | | 8/1993 | Chang |
| 5,235,248 | A | | 8/1993 | Clark et al. |
| 5,262,656 | A | | 11/1993 | Blondeau et al. |
| 5,263,043 | A | | 11/1993 | Walsh |
| 5,268,693 | A | | 12/1993 | Walsh |
| 5,268,788 | A | | 12/1993 | Fox et al. |
| 5,282,197 | A | | 1/1994 | Kreitzer |
| 5,283,819 | A | | 2/1994 | Glick et al. |
| 5,293,175 | A | | 3/1994 | Hemmie et al. |
| 5,302,240 | A | | 4/1994 | Hori et al. |
| 5,305,312 | A | | 4/1994 | Fornek et al. |
| 5,341,374 | A | | 8/1994 | Lewen et al. |
| 5,354,709 | A | | 10/1994 | Lorenzo et al. |
| 5,446,814 | A | | 8/1995 | Kuo et al. |
| 5,485,277 | A | * | 1/1996 | Foster ..... 356/445 |
| 5,504,341 | A | | 4/1996 | Glavish |
| 5,578,909 | A | | 11/1996 | Billen |
| 5,604,352 | A | | 2/1997 | Schuetz |
| 5,608,263 | A | | 3/1997 | Drayton et al. |
| 5,663,971 | A | | 9/1997 | Carlsten |
| 5,666,020 | A | | 9/1997 | Takemura |
| 5,668,368 | A | | 9/1997 | Sakai et al. |
| 5,705,443 | A | | 1/1998 | Stauf et al. |
| 5,737,458 | A | | 4/1998 | Wojnarowski et al. |
| 5,744,919 | A | | 4/1998 | Mishin et al. |
| 5,757,009 | A | | 5/1998 | Walstrom |
| 5,767,013 | A | | 6/1998 | Park |
| 5,780,970 | A | | 7/1998 | Singh et al. |
| 5,790,585 | A | | 8/1998 | Walsh |
| 5,811,943 | A | | 9/1998 | Mishin et al. |
| 5,821,836 | A | | 10/1998 | Katehi et al. |
| 5,821,902 | A | | 10/1998 | Keen |
| 5,825,140 | A | | 10/1998 | Fujisawa |
| 5,831,270 | A | | 11/1998 | Nakasuji |
| 5,847,745 | A | | 12/1998 | Shimizu et al. |
| 5,858,799 | A | * | 1/1999 | Yee et al. ..... 436/164 |
| 5,889,449 | A | | 3/1999 | Fiedziuszko |
| 5,889,797 | A | | 3/1999 | Nguyen |
| 5,902,489 | A | | 5/1999 | Yasuda et al. |
| 5,963,857 | A | | 10/1999 | Greywall |
| 5,972,193 | A | | 10/1999 | Chou et al. |
| 6,005,347 | A | | 12/1999 | Lee |
| 6,008,496 | A | | 12/1999 | Winefordner et al. |
| 6,040,625 | A | | 3/2000 | Ip |
| 6,060,833 | A | | 5/2000 | Velazco |
| 6,080,529 | A | | 6/2000 | Ye et al. |
| 6,117,784 | A | | 9/2000 | Uzoh |
| 6,139,760 | A | | 10/2000 | Shim et al. |
| 6,180,415 | B1 | | 1/2001 | Schultz et al. |
| 6,195,199 | B1 | | 2/2001 | Yamada |
| 6,222,866 | B1 | | 4/2001 | Seko |
| 6,278,239 | B1 | | 8/2001 | Caporaso et al. |
| 6,281,769 | B1 | | 8/2001 | Fiedziuszko |
| 6,297,511 | B1 | | 10/2001 | Syllaios et al. |
| 6,301,041 | B1 | | 10/2001 | Yamada |
| 6,309,528 | B1 | | 10/2001 | Taylor et al. |
| 6,316,876 | B1 | | 11/2001 | Tanabe |
| 6,338,968 | B1 | | 1/2002 | Hefti |
| 6,370,306 | B1 | | 4/2002 | Sato et al. |
| 6,373,194 | B1 | | 4/2002 | Small |
| 6,376,258 | B2 | | 4/2002 | Hefti |
| 6,407,516 | B1 | | 6/2002 | Victor |
| 6,441,298 | B1 | | 8/2002 | Thio |
| 6,448,850 | B1 | | 9/2002 | Yamada |
| 6,453,087 | B2 | | 9/2002 | Frish et al. |
| 6,470,198 | B1 | | 10/2002 | Kintaka et al. |
| 6,504,303 | B2 | | 1/2003 | Small |
| 6,525,477 | B2 | | 2/2003 | Small |
| 6,534,766 | B2 | | 3/2003 | Abe et al. |
| 6,545,425 | B2 | | 4/2003 | Victor |
| 6,552,320 | B1 | | 4/2003 | Pan |
| 6,577,040 | B2 | | 6/2003 | Nguyen |
| 6,580,075 | B2 | | 6/2003 | Kametani et al. |
| 6,603,781 | B1 | | 8/2003 | Stinson et al. |
| 6,603,915 | B2 | | 8/2003 | Glebov et al. |
| 6,624,916 | B1 | | 9/2003 | Green et al. |
| 6,636,185 | B1 | | 10/2003 | Spitzer et al. |
| 6,636,534 | B2 | | 10/2003 | Madey et al. |
| 6,636,653 | B2 | | 10/2003 | Miracky et al. |
| 6,640,023 | B2 | | 10/2003 | Miller et al. |
| 6,642,907 | B2 | | 11/2003 | Hamada et al. |
| 6,687,034 | B2 | | 2/2004 | Wine et al. |
| 6,700,748 | B1 | | 3/2004 | Cowles et al. |
| 6,724,486 | B1 | | 4/2004 | Shull et al. |
| 6,738,176 | B2 | | 5/2004 | Rabinowitz et al. |
| 6,741,781 | B2 | | 5/2004 | Furuyama |

6,777,244 B2 * 8/2004 Pepper et al. ..... 436/165
6,782,205 B2 8/2004 Trisnadi et al.
6,791,438 B2 9/2004 Takahashi et al.
6,800,877 B2 10/2004 Victor et al.
6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,122,978 B2 10/2006 Nakanishi et al.
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,470,920 B2 12/2008 Gorrell et al.
7,473,917 B2 1/2009 Singh
7,586,097 B2 9/2009 Gorrell et al.
7,586,167 B2 9/2009 Gorrell et al.
2001/0002315 A1 5/2001 Schultz et al.
2001/0025925 A1 10/2001 Abe et al.
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 5/2002 Winkler et al.
2002/0068018 A1 6/2002 Pepper et al.
2002/0070671 A1 6/2002 Small
2002/0071457 A1 6/2002 Hogan
2002/0122531 A1 9/2002 Whitham
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016421 A1 1/2003 Small
2003/0034535 A1 2/2003 Barenburg et al.
2003/0103150 A1 6/2003 Catrysse et al.
2003/0106998 A1 6/2003 Colbert et al.
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes
2003/0214695 A1 11/2003 Abramson et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 6/2004 Melnychuk et al.
2004/0108823 A1 6/2004 Amaldi et al.
2004/0136715 A1 7/2004 Kondo
2004/0150991 A1 8/2004 Ouderkirk et al.
2004/0171272 A1 9/2004 Jin et al.
2004/0180244 A1 9/2004 Tour et al.
2004/0184270 A1 9/2004 Halter
2004/0213375 A1 10/2004 Bjorkholm et al.
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0067286 A1 3/2005 Ahn et al.
2005/0082469 A1 4/2005 Carlo
2005/0092929 A1 5/2005 Schneiker
2005/0104684 A1 5/2005 Wojcik
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0190637 A1 9/2005 Ichimura et al.
2005/0194258 A1 9/2005 Cohen et al.
2005/0201707 A1 9/2005 Glebov et al.
2005/0201717 A1 9/2005 Matsumura et al.
2005/0212503 A1 9/2005 Deibele
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell
2006/0060782 A1 3/2006 Khursheed
2006/0062258 A1 3/2006 Brau et al.
2006/0131176 A1 6/2006 Hsu
2006/0131695 A1 6/2006 Kuekes et al.
2006/0159131 A1 7/2006 Liu et al.
2006/0164496 A1 7/2006 Tokutake et al.
2006/0187794 A1 8/2006 Harvey et al.
2006/0208667 A1 9/2006 Lys et al.
2006/0216940 A1 9/2006 Gorrell et al.
2006/0243925 A1 11/2006 Barker et al.
2006/0274922 A1 12/2006 Ragsdale
2007/0003781 A1 1/2007 de Rochemont
2007/0013765 A1 1/2007 Hudson et al.
2007/0075263 A1 4/2007 Gorrell et al.
2007/0075264 A1 4/2007 Gorrell et al.
2007/0085039 A1 4/2007 Gorrell et al.
2007/0086915 A1 4/2007 LeBoeuf et al.
2007/0116420 A1 5/2007 Estes et al.
2007/0146704 A1 6/2007 Schmidt et al.
2007/0152176 A1 7/2007 Gorrell et al.
2007/0154846 A1 7/2007 Gorrell et al.
2007/0194357 A1 8/2007 Oohashi
2007/0200940 A1 8/2007 Gruhlke et al.
2007/0238037 A1 10/2007 Wuister et al.
2007/0252983 A1 11/2007 Tong et al.
2007/0258492 A1 11/2007 Gorrell
2007/0258689 A1 11/2007 Gorrell et al.

| | | | |
|---|---|---|---|
| 2007/0258690 | A1 | 11/2007 | Gorrell et al. |
| 2007/0259641 | A1 | 11/2007 | Gorrell |
| 2007/0264023 | A1 | 11/2007 | Gorrell et al. |
| 2007/0264030 | A1 | 11/2007 | Gorrell et al. |
| 2007/0282030 | A1 | 12/2007 | Anderson et al. |
| 2007/0284527 | A1 | 12/2007 | Zani et al. |
| 2008/0069509 | A1 | 3/2008 | Gorrell et al. |
| 2008/0302963 | A1 | 12/2008 | Nakasuji et al. |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 00/072413 | | 11/2000 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.
Markoff, John, "A Chip That Can Transfer Data Using Laser Light," The New York Times, Sep. 18, 2006.
S.M. Sze, "Semiconductor Devices Physics and Technology", 2nd Edition, Chapters 9 and 12, Copyright 1985, 2002.
Search Report and Written Opinion mailed Feb. 12, 2007 in PCT Appln. No. PCT/US2006/022682.
Search Report and Written Opinion mailed Feb. 20, 2007 in PCT Appln. No. PCT/US2006/022676.
Search Report and Written Opinion mailed Feb. 20, 2007 in PCT Appln. No. PCT/US2006/022772.
Search Report and Written Opinion mailed Feb. 20, 2007 in PCT Appln. No. PCT/US2006/022780.
Search Report and Written Opinion mailed Feb. 21, 2007 in PCT Appln. No. PCT/US2006/022684.
Search Report and Written Opinion mailed Jan. 17, 2007 in PCT Appln. No. PCT/US2006/022777.
Search Report and Written Opinion mailed Jan. 23, 2007 in PCT Appln. No. PCT/US2006/022781.
Search Report and Written Opinion mailed Mar. 7, 2007 in PCT Appln. No. PCT/US2006/022775.
Speller et al., "A Low-Noise MEMS Accelerometer for Unattended Ground Sensor Applications", Applied MEMS Inc., 12200 Parc Crest, Stafford, TX, USA 77477.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
"An Early History—Invention of the Klystron," http://varianinc.com/cgi-bin/advprint/print.cgi?cid=KLQNPPJJFJ, printed on Dec. 26, 2008.
"An Early History—The Founding of Varian Associates," http://varianinc.com/cgi-bin/advprint/print.cgi?cid=KLQNPPJJFJ, printed on Dec. 26, 2008.
"Chapter 3 X-Ray Tube," http://compepid.tuskegee.edu/syllabi/clinical/small/radiology/chapter..., printed from tuskegee.edu on Dec. 29, 2008.
"Diagnostic imaging modalities—Ionizing vs non-ionizing radiation," http://info.med.yale.edu/intmed/cardio/imaging/techniques/ionizing_v..., printed from Yale University School of Medicine on Dec. 29, 2008.
"Frequently Asked Questions," Luxtera Inc., found at http://www.luxtera.com/technology_faq.htm, printed on Dec. 2, 2005, 4 pages.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Making X-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"Notice of Allowability" mailed on Jan. 17, 2008 in U.S. Appl. No. 11/418,082, filed May 5, 2006.
"Technology Overview," Luxtera, Inc., found at http://www.luxtera.com/technology.htm, printed on Dec. 2, 2005, 1 page.
"The Reflex Klystron," http://www.fnrfscience.cmu.ac.th/theory/microwave/microwave%2, printed from Fast Netoron Research Facilty on Dec. 26, 2008.
"x-ray tube," http://www.answers.com/topic/x-ray-tube, printed on Dec. 29, 2008.
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.
May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.
Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
Corcoran, Elizabeth, "Ride the Light," Forbes Magazine, Apr. 11, 2005, pp. 68-70.
European Search Report mailed Mar. 3, 2009 in European Application No. 06852028.7.
Neo et al., "Smith-Purcell Radiation from Ultraviolet to Infrared Using a Si-field Emitter" Vacuum Electronics Conference, 2007, IVEC '07, IEEE International May 2007.
Ossia, Babak, "The X-Ray Production," Department of Biomedical Engineering—University of Rhode Island, 1 page.
Sadwick, Larry et al., "Microfabricated next-generation millimeter-wave power amplifiers," www.rfdesign.com.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.

Search Report and Writen Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
Thumm, Manfred, "Historical German Contributions to Physics and Applications of Electromagnetic Oscillations and Waves."
U.S. Appl. No. 11/203,407—Nov. 13, 2008 PTO Office Action.
U.S. Appl. No. 11/238,991—Dec. 6, 2006 PTO Office Action.
U.S. Appl. No. 11/238,991—Jun. 6, 2007 Response to PTO Office Action of Dec. 6, 2006.
U.S. Appl. No. 11/238,991—Sep. 10, 2007 PTO Office Action.
U.S. Appl. No. 11/238,991—Mar. 6, 2008 Response to PTO Office Action of Sep. 10, 2007.
U.S. Appl. No. 11/238,991—Jun. 27, 2008 PTO Office Action.
U.S. Appl. No. 11/238,991—Dec. 29, 2008 Response to PTO Office Action of Jun. 27, 2008.
U.S. Appl. No. 11/238,991—Mar. 24, 2009 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.
U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129—Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12, 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,083—Jun. 20, 2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appl. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.

U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
Whiteside, Andy et al., "Dramatic Power Savings using Depressed Collector IOT Transmitters in Digital and Analog Service."
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
"Array of Nanoklystrons for Frequency Agility or Redundancy," NASA's Jet Propulsion Laboratory, NASA Tech Briefs, NPO-21033. 2001.
"Hardware Development Programs," Calabazas Creek Research, Inc. found at http://calcreek.com/hardware.html.
"Antenna Arrays." May 18, 2002. www.tpub.com/content/neets/14183/css/14183_159.htm.
"Diffraction Grating," hyperphysics.phy-astr.gsu.edu/hbase/phyopt/grating.html.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Backe, H. et al. "Investigation of Far-Infrared Smith-Purcell Radiation at the 3.41 MeV Electron Injector Linac of the Mainz Microtron MAMI," Institut fur Kernphysik, Universitat Mainz, D-55099, Mainz Germany.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bakhtyari, Dr. Arash, "Gain Mechanism in a Smith-Purcell MicroFEL," Abstract, Department of Physics and Astronomy, Dartmouth College.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Booske, J.H. et al., "Microfabricated TWTs as High Power, Wideband Sources of THz Radiation".
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Gallerano, G.P. et al., "Overview of Terahertz Radiation Sources," Proceedings of the 2004 FEL Conference, pp. 216-221.
Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.
Gover, A. et al., "Angular Radiation Pattern of Smith-Purcell Radiation," Journal of the Optical Society of America, Oct. 1984, pp. 723-728, vol. 1 No. 5, Optical Society of America.
Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.
Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.
Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.
Ives, Lawrence et al., "Development of Backward Wave Oscillators for Terahertz Applications," Terahertz for Military and Security Applications, Proceedings of SPIE vol. 5070 (2003), pp. 71-82.
Ives, R. Lawrence, "IVEC Summary, Session 2, Sources I" 2002.
Jonietz, Erika, "Nano Antenna Gold nanospheres show path to all-optical computing," Technology Review, Dec. 2005/Jan. 2006, p. 32.
Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA Nov. 1995 pp. 117-121.
Joo, Youngcheol et al., "Fabrication of Monolithic Microchannels for IC Chip Cooling," 1995, Mechanical, Aerospace and Nuclear Engineering Department, University of California at Los Angeles.
Jung, K.B. et al., "Patterning of Cu, Co, Fe, and Ag for magnetic nanostructures," J. Vac. Sci. Technol. A 15(3), May/Jun. 1997, pp. 1780-1784.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.

Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Korbly, S.E. et al., "Progress on a Smith-Purcell Radiation Bunch Length Diagnostic," Plasma Science and Fusion Center, MIT, Cambridge, MA.
Kormann, T. et al., "A Photoelectron Source for the Study of Smith-Purcell Radiation".
Kube, G. et al., "Observation of Optical Smith-Purcell Radiation at an Electron Beam Energy of 855 MeV," Physical Review E, May 8, 2002, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
Manohara, Harish M. et al., "Design and Fabrication of a THz Nanoklystron".
Manohara, Harish M. et al., "Design and Fabrication of a THz Nanoklystron" (www.sofia.usra.edu/det_workshop/ posters/session 3/3-43manohara_poster.pdf), PowerPoint Presentation.
McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Mokhoff, Nicolas, "Optical-speed light detector promises fast space talk," EETimes Online, Mar. 20, 2006, from website: www.eetimes.com/showArticle.jhtml?articleID=183701047.
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in CI2/O2 and O2 glow discharges," J. Vac. Sci, Technol. B. 17 (5), Sep./Oct. 1999, American Vacuum Society, pp. 2204-2209.
Ohtaka, Kazuo, "Smith-Purcell Radiation from Metallic and Dielectric Photonic Crystals," Center for Frontier Science, pp. 272-273, Chiba University, 1-33 Yayoi, Inage-ku, Chiba-shi, Japan.
Phototonics Research, "Surface-Plasmon-Enhanced Random Laser Demonstrated," Phototonics Spectra, Feb. 2005, pp. 112-113.
Platt, C.L. et al., "A New Resonator Design for Smith-Purcell Free Electron Lasers," 6Q19, p. 296.
Potylitsin, A.P., "Resonant Diffraction Radiation and Smith-Purcell Effect," (Abstract), arXiv: physics/9803043 v2 Apr. 13, 1998.
Potylitsyn, A.P., "Resonant Diffraction Radiation and Smith-Purcell Effect," Physics Letters A, Feb. 2, 1998, pp. 112-116, A 238, Elsevier Science B.V.
S. Hoogland et al., "A solution-processed 1.53 μm quantum dot laser with temperature-invariant emission wavelength," Optics Express, vol. 14, No. 8, Apr. 17, 2006, pp. 3273-3281.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.
Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.
Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.
Shih, I. et al., "Experimental Investigations of Smith-Purcell Radiation," Journal of the Optical Society of America, Mar. 1990, pp. 351-356, vol. 7, No. 3, Optical Society of America.
Shih, I. et al., "Measurements of Smith-Purcell Radiation," Journal of the Optical Society of America, Mar. 1990, pp. 345-350, vol. 7 No. 3, Optical Society of America.
Swartz, J.C. et al., "THz-FIR Grating Coupled Radiation Source," Plasma Science, 1998. 1D02, p. 126.
Temkin, Richard, "Scanning with Ease Through the Far Infrared," Science, New Series, May 8, 1998, p. 854, vol. 280, No. 5365, American Association for the Advancement of Science.
Walsh, J.E., et al., 1999. From website: http://www.ieee.org/organizations/pubs/newsletters/leos/feb99/hot2.htm.
Wentworth, Stuart M. et al., "Far-Infrared Composite Microbolometers," IEEE MTT-S Digest, 1990, pp. 1309-1310.
Yamamoto, N. et al., "Photon Emission From Silver Particles Induced by a High-Energy Electron Beam," Physical Review B, Nov. 6, 2001, pp. 205419-1-205419-9, vol. 64, The American Physical Society.
Yokoo, K. et al., "Smith-Purcell Radiation at Optical Wavelength Using a Field-Emitter Array," Technical Digest of IVMC, 2003, pp. 77-78.
Zeng, Yuxiao et al., "Processing and encapsulation of silver patterns by using reactive ion etch and ammonia anneal," Materials Chemistry and Physics 66, 2000, pp. 77-82.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27-F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/238,991—May 11, 2009 PTO Office Action.
U.S. Appl. No. 11/350,812—Apr. 17, 2009 Office Action.
U.S. Appl. No. 11/411,130—Jun. 23, 2009 PTO Office Action.
U.S. Appl. No. 11/418,096—Jun. 23, 2009 PTO Office Action.
U.S. Appl. No. 11/433,486—Jun. 19, 2009 PTO Office Action.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith—Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.

U.S. Appl. No. 11/418,089—Jul. 15, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appln. No. PCT/US2006/024218.

* cited by examiner

ELECTRON ACCELERATOR FOR ULTRA-SMALL RESONANT STRUCTURES

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

CROSS-REFERENCE TO RELATED APPLICATIONS

The present invention is related to the following co-pending U.S. Patent applications which are all commonly owned with the present application, the entire contents of each of which are incorporated herein by reference:

1. U.S. patent application Ser. No. 11/238,991, entitled "Ultra-Small Resonating Charged Particle Beam Modulator," filed Sep. 30, 2005;
2. U.S. patent application Ser. No. 10/917,511, entitled "Patterning Thin Metal Film by Dry Reactive Ion Etching," filed on Aug. 13, 2004;
3. U.S. application Ser. No. 11/203,407, entitled "Method Of Patterning Ultra-Small Structures," filed on Aug. 15, 2005;
4. U.S. application Ser. No. 11/243,476, entitled "Structures And Methods For Coupling Energy From An Electromagnetic Wave," filed on Oct. 5, 2005;
5. U.S. application Ser. No. 11/243,477, entitled "Electron beam induced resonance," filed on Oct. 5, 2005;
6. U.S. application Ser. No. 11/325,448, entitled "Selectable Frequency Light Emitter from Single Metal Layer," filed Jan. 5, 2006;
7. U.S. application Ser. No. 11/325,432, entitled, "Matrix Array Display," filed Jan. 5, 2006;
8. U.S. application Ser. No. 11/302,471, entitled "Coupled Nano-Resonating Energy Emitting Structures," filed Dec. 14, 2005;
9. U.S. application Ser. No. 11/325,571, entitled "Switching Micro-resonant Structures by Modulating a Beam of Charged Particles," filed Jan. 5, 2006;
10. U.S. application Ser. No. 11/325,534, entitled "Switching Microresonant Structures Using at Least One Director," filed Jan. 5, 2006;
11. U.S. application Ser. No. 11/350,812, entitled "Conductive Polymers for Electroplating," filed Feb. 10, 2006;
12. U.S. application Ser. No. 11/349,963, entitled "Method and Structure for Coupling Two Microcircuits," filed Feb. 9, 2006;
13. U.S. application Ser. No. 11/353,208, entitled "Electron Beam Induced Resonance," filed Feb. 14, 2006; and
14. U.S. application Ser. No. 11/400,280, entitled "Resonant Detector for Optical Signals," filed Apr. 10, 2006.

FIELD OF DISCLOSURE

This relates in general to electron accelerators for resonant structures.

Introduction

We have previously described in the related applications identified above a number of different inventions involving novel ultra-small resonant structures and methods of making and utilizing them. In essence, the ultra-small resonant structures emit electromagnetic radiation at frequencies (including but not limited to visible light frequencies) not previously obtainable with characteristic structures nor by the operational principles described. In some of those applications of these ultra-small resonant structures, we identify electron beam induced resonance. In such embodiments, the electron beam passes proximate to an ultra-small resonant structure—sometimes a resonant cavity—causing the resonant structure to emit electromagnetic radiation; or in the reverse, incident electromagnetic radiation proximate the resonant structure causes physical effects on the proximate electron beam. As used herein, an ultra-small resonant structure can be any structure with a physical dimension less than the wavelength of microwave radiation, which (1) emits radiation (in the case of a transmitter) at a microwave frequency or higher when operationally coupled to a charge particle source or (2) resonates (in the case of a detector/receiver) in the presence of electromagnetic radiation at microwave frequencies or higher.

Thus, the resonant structures in some embodiments depend upon a coupled, proximate electron beam. We also have identified that the charge density and velocity of the electron beam can have some effects on the response returned by the resonant structure. For example, in some cases, the properties of the electron beam may affect the intensity of electromagnetic radiation. In other cases, it may affect the frequency of the emission.

As a general matter, electron beam accelerators are not new, but they are new in the context of the affect that beam acceleration can have on novel ultra-small resonant structures. By controlling the electron beam velocity, valuable characteristics of the ultra-small resonant structures can be accommodated.

Also, we have previously described in the related cases how the ultra-small resonant structures can be accommodated on integrated chips. One unfortunate side effect of such a placement can be the location of a relatively high-powered cathode on or near the integrated chip. For example, in some instances, a power source of 100s or 1000s eV will produce desirable resonance effects on the chip (such applications may—but need not—include intra-chip communications, inter-chip communications, visible light emission, other frequency emission, electromagnetic resonance detection, display operation, etc.) Putting such a power source on-chip is disadvantageous from the standpoint of its potential affect on the other chip components although it is highly advantageous for operation of the ultra-small resonant structures.

We have developed a system that allows the electrons to gain the benefit usually derived from high-powered electron sources, without actually placing a high-powered electron source on-chip.

PRESENTLY PREFERRED EXEMPLARY EMBODIMENTS

Transmitter 10 includes ultra-small resonant structures 12 that emit encoded light 15 when an electron beam 11 passes proximate to them. Such ultra-small resonant structures can be one or more of those described in U.S. patent application Ser. Nos. 11/238,991; 11/243,476; 11/243,477; 11/325,448; 11/325,432; 11/302,471; 11/325,571; 11/325,534; 11/349,963; and/or 11/353,208 (each of which is identified more particularly above). The resonant structures in the transmitter can be manufactured in accordance with any of U.S. application Ser. Nos. 10/917,511; 11/350,812; or 11/203,407 (each of which is identified more particularly above) or in other ways. Their sizes and dimensions can be selected in accordance with the principles described in those and the other above-identified applications and, for the sake of brevity, will not be repeated herein. The contents of the applications described above are assumed to be known to the reader.

Figure 1:
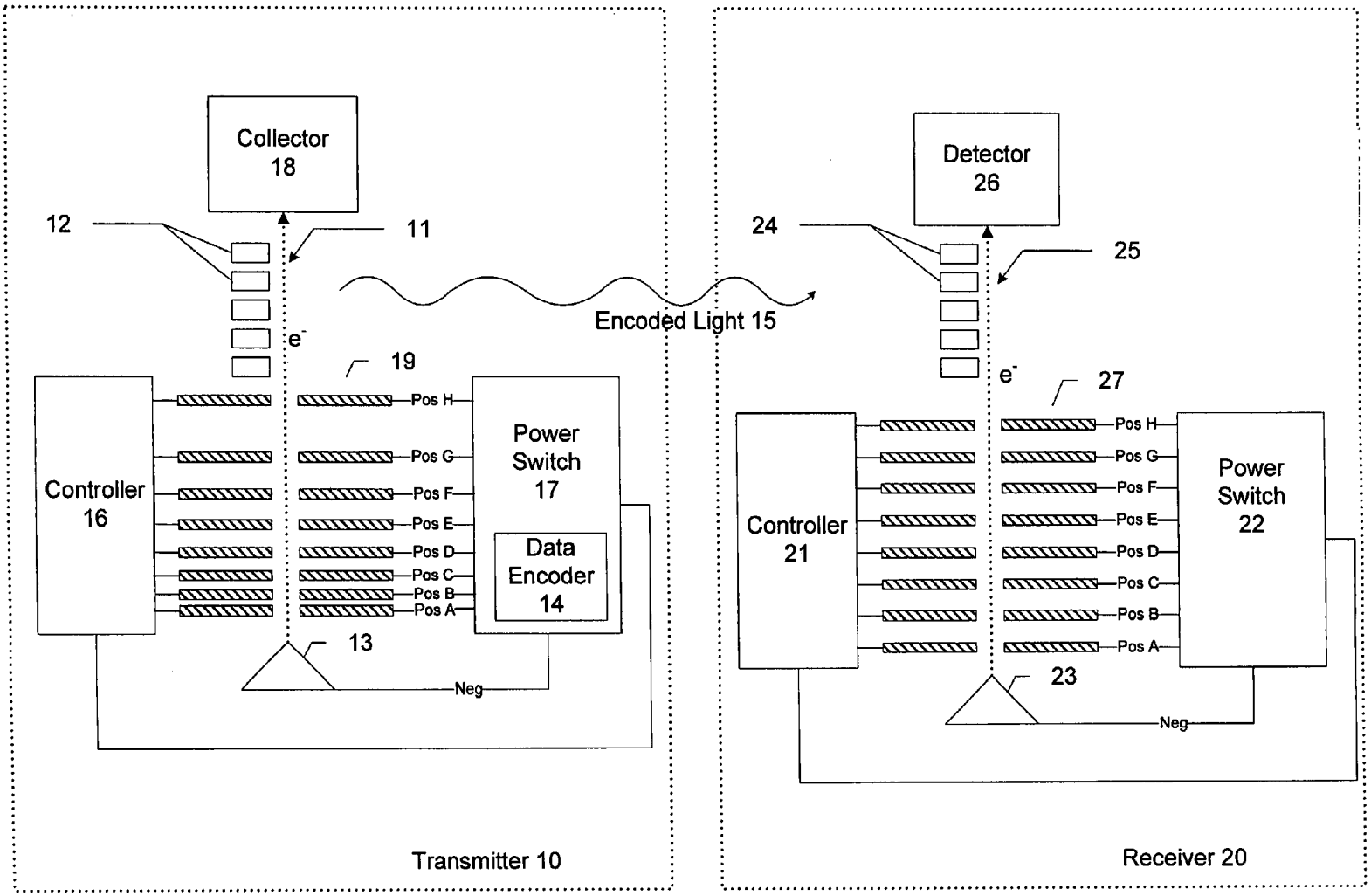
FIG. 1 is a schematic view of a transmitter and detector employing ultra-small resonant structures and two alternative types of electron accelerators.

The ultra-small resonant structures have one or more physical dimensions that can be smaller than the wavelength of the electromagnetic radiation emitted (in the case of FIG. 1, encoded light 15, but in other embodiments, the radiation can have microwave frequencies or higher). The ultra-small resonant structures operate under vacuum conditions. In such an environment, as the electron beam 11 passes proximate the resonant structures 12, it causes the resonant structures to resonate and emit the desired encoded light 15. The light 15 is encoded by the electron beam 11 via operation of the cathode 13 by the power switch 17 and data encoder 14.

In a simple case, the encoded light 15 can be encoded by the data encoder 14 by simple ON/OFF pulsing of the electron beam 11 by the cathode 13. In more sophisticated scenarios, the electron density may be employed to encode the light 15 by the data encoder 14 through controlled operation of the cathode 13.

In the transmitter 10, if an electron acceleration level normally developed under a 4000 eV power source (a number chosen solely for illustration, and could be any energy level whatsoever desired) is desired, the respective anodes connected to the Power Switch 17 at Positions A-H will each have a potential relative to the cathode of 1/n times the desired power level, where n is the number of anodes in the series. Any number of anodes can be used. In the case of FIG. 1, eight anodes are present. In the example identified above, the potential between each anode and the cathode 13 is 4000V/8=500V per anode.

The Power switch 13 then requires only a 500V potential relative to ground because each anode only requires 500V, which is vastly an advantageously lower potential on the chip than 4000V.

Figure 2:
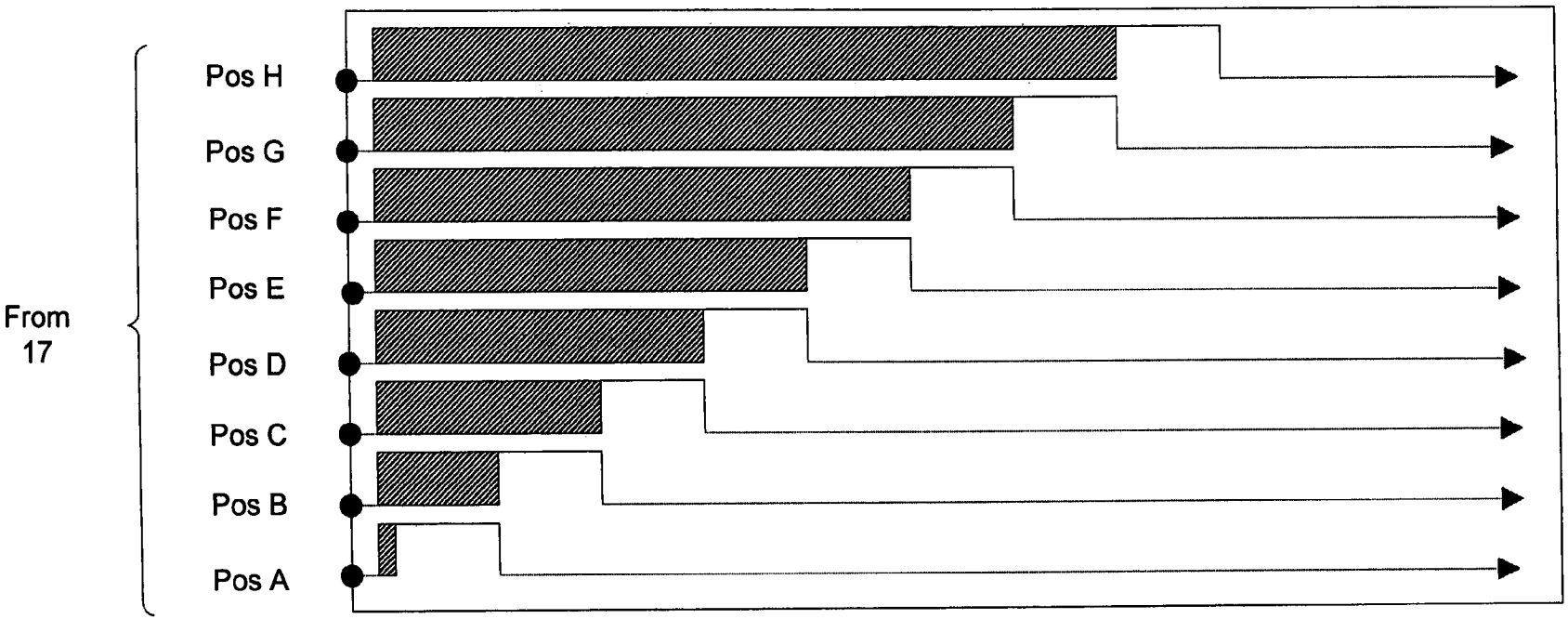
FIG. 2 is a timing diagram for the electron accelerator in the transmitter of FIG. 1.

In the system without multiple anodes, a 500V potential on a single anode will not accelerate the electron beam 11 at nearly the same level as provided by the 4000V source. But, the system of FIG. 1 obtains the same level of acceleration as the 4000V using multiple anodes and careful selection of the anodes at the much lower 500V voltage. In operation, the anodes at Positions A-H turn off as the electron beam passes by, causing the electron beam to accelerate toward the next sequential anode. As shown in the timing diagram of FIG. 2, the power switch 17 controls the potential at each anode in Position A through Position H sequentially as the electron beam passes by the respective anodes. In FIG. 2, the y-axis represents the ON/OFF potential at the anode and the x-axis represents time. At the start, all of the anodes are in a "don't care" state represented by the hatched lines. "Don't care" means that the anodes can be on, off, or switching without material effect on the system. At a particular time, the Position A anode turns ON, as shown, while the remaining anodes remain in the "don't care" state. The ON state indicates a potential between the anode and the cathode 13, such that the electron beam 11 from the cathode 13 is accelerated toward the anode at Position A. Once the electron beam reaches at or near the anode at Position A, the Position A anode turns OFF, as shown in FIG. 2, and the Position B anode turns ON causing the electron beam passing Position A to further accelerate toward Position B. When it reaches at or near Position B, the Position B anode turns off and the Position C anode turns ON, a shown in FIG. 2. The process of turning sequential anodes ON continues, as shown in FIG. 2, as the electron beam reaches at or near each sequential anode position.

After passing Position H in the transmitter 10 of FIG. 1, the electron beam has accelerated to essentially the same level as it would have if only one high voltage anode had been present.

The anodes in transmitter 10 are turned ON and OFF as the electron beam reaches the respective anodes. One way (although not the only way) that the system can know when the electron beam is approaching the respective anodes is to provide controller 16 to sense when an induced current appears on the respective anode caused by the approaching electron beam. When the controller 16 senses a current at a particular threshold level in the anode at Position A, for example, it instructs the power switch 17 to switch the anode at Position A OFF and the anode at Position B ON, and so on, as shown in FIG. 2. The threshold can be chosen to essentially correspond with the approach (or imminent passing) of the electron beam at the particular anode being sensed. The power switch 17 can switch an anode OFF when the threshold is reached under the assumption that the electron beam has sufficiently accelerated to that anode and can now best be further accelerated by attraction to the next sequential anode.

After the electron beam has accelerated to each sequential anode 10, the accelerated electron beam 11 can then pass the resonant structures 12, causing them to emit the electromagnetic radiation encoded by the data encoder 14. The resonant structures 12/24 are shown generically and on only one side, but they may be any of the ultra-small resonant structure forms described in the above-identified applications and can be on both sides of the electron beam. Collector 18 can receive the electron beam and either use the power associated with it for on-chip power or take it to ground.

Figure 3:
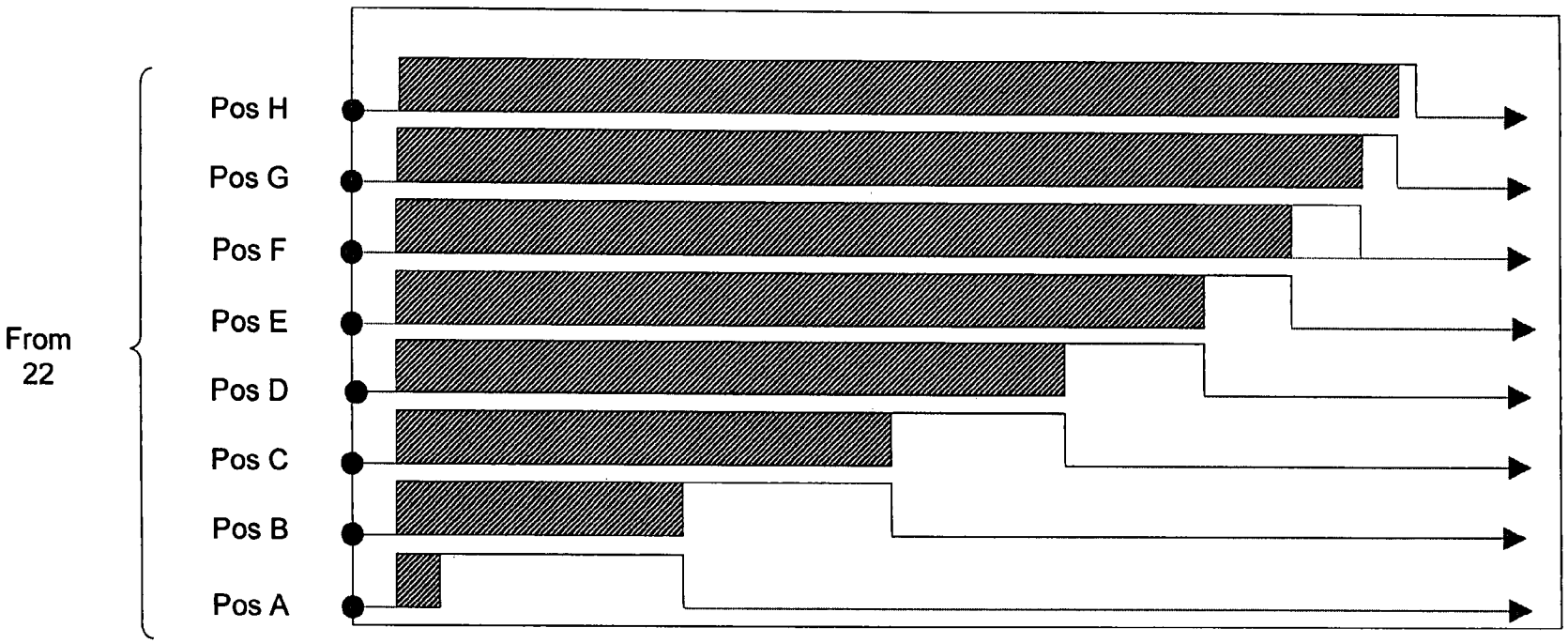
FIG. 3 is a timing diagram for the electron accelerator in the receiver of FIG. 1.

In the transmitter of FIG. 1, each anode is turned ON for the same length of time. Because the electron beam 11 is accelerating as it passes the respective anodes, the anodes 19 are spaced increasingly further apart only the path of the electron beam so the evenly timed ON states will coincide with the arriving electron beam. As can now be understood from that description, the distance between the anodes and the timing of the ON pulses can be varied. Thus, the Receiver 20 in FIG. 1 has a set of anodes 27 that are evenly spaced. In that embodiment, as the electron beam 25 from cathode 23 accelerates, the ON states of the anodes 27 controlled by controller 21 and invoked by power switch 22 at the Positions A-H will shorten as the electron beam approaches the resonant structures 24 (i.e., as the electron beam continues to accelerate). FIG. 3 shows an example timing diagram for the anode switching in the receiver 20 of FIG. 1. As in FIG. 2, the y-axis represents the ON/OFF state (hatched sections represent "don't care") and the x-axis represents time.

In FIG. 3, as the electron beam starts out from cathode 23, it will take more time to reach the anode at Position A and thus the ON state is relatively long. As the electron beam accelerates to Position H, it has substantially increased its velocity such that the ON state for the anode at Position H is relatively short.

Other alternatives systems that incorporate different spacing aspects for the anodes and corresponding different timing aspects will now be apparent to the artisan after reviewing FIGS. 2 and 3. That is, various hybrids between the systems of FIGS. 2 and 3 can be envisioned.

To complete the description of the operation of FIG. 1, in the receiver 20, the electron beam passes the resonant structures 24, which have received the encoded light 15. The effect of the encoded light 15 on the resonant structures 24 causes the electron beam 25 to bend, which is detected by detector 26. In that way, the encoded data in the encoded light 15 is demodulated by detector 26.

To facilitate the acceleration of the electrons between the anodes 19, the electron beam should preferably be pulsed. In that way, one electron pulse can be accelerated to, sequentially, the first, second, third, etc. anodes (Positions A, B, C, etc) before the next pulse of electrons begins. The number of anodes that an earlier pulse of electrons must reach before a next pulse can start will, of course, depend on the influence that the re-energized earlier anodes have on the since-departed electron group. It is advantageous that the re-energizing of the anode at Position A, for example, as a subsequent electron pulse approaches it does not materially slow the earlier electron pulse that is at a later position in the anode stream.

Figure 4:
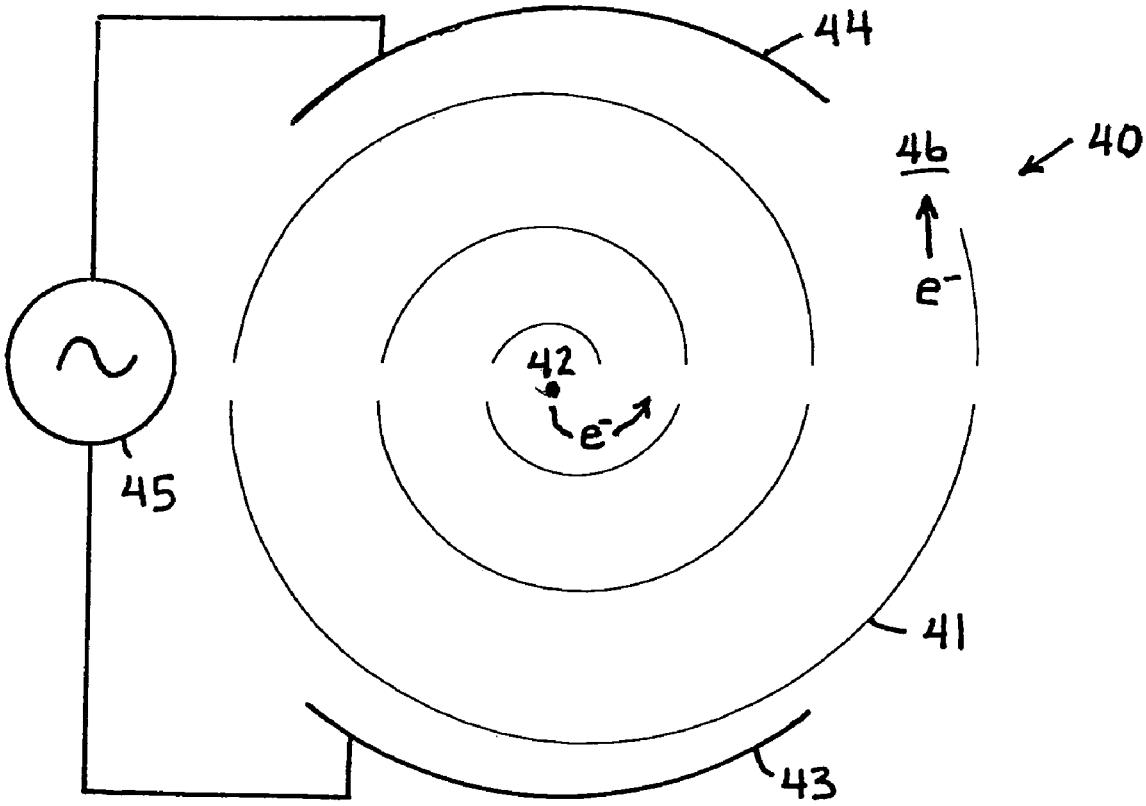
FIG. 4 is another alternative electron accelerator for use with ultra-small resonance structures.

FIG. 4 illustrates an alternative structure for the accelerator 40 that could substitute for the anodes 19 or the anodes 27. In FIG. 4, a cyclotron is shown in which the cathode 42 emits electrons into a spiral. A magnetic field in a line perpendicular to the plane of FIG. 4, combined with an alternative RF field provided by RF source 45 and electrodes 43 and 44, causes the electron beam from the cathode 42 to accelerate around the spiral. That is, if the polarity transitions between the electrodes 43 and 44 are evenly timed by source 45, then the electrons traveling around each consecutive "ring" of the spiral will travel a longer distance in the same amount of time (hence, their acceleration). When the electrons leave the spiral at position 46, they have accelerated substantially even using a relatively low power source.

The magnetic field in FIG. 4 may be advantageously shielded from other circuit components (for example, when the transmitter and/or receiver are on physically mounted on an IC having other electric components). With shielding, the influence of the magnetic field can be localized to the accelerator 40 without materially affecting other, unrelated elements.

While certain configurations of structures have been illustrated for the purposes of presenting the basic structures of the present invention, one of ordinary skill in the art will appreciate that other variations are possible which would still fall within the scope of the appended claims. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A transmitter, comprising:

a cathode emitting electrons;

two or more anodes arranged sequentially downstream of the electrons emitted by the cathode;

a power source operationally associated with a power switch to provide power to selected ones of the two or more anodes based on positions of the electrons relative to the selected anodes;

at least one ultra-small resonant structure downstream of the two or more anodes and located proximate the electron beam whereby the resonant structures emit electromagnetic radiation at least in part due to the passing proximate electron beam.

2. A transmitter according to claim 1, wherein:

the two or more anodes are physically spaced at generally evenly spaced.

3. A transmitter according to claim 2, wherein:

power switch switches power to anodes farther downstream of the cathode for shorter durations than for anodes nearer the cathode.

4. A transmitter according to claim 1, further including:

a controller to provide the power switch with a timing to turn power ON respectively to the two or more anodes.

5. A transmitter according to claim 4, wherein the controller instructs the power switch to turn a respective one of the two or more anodes OFF when it senses a position of the electron beam relative to the one anode being turned OFF.

6. A transmitter according to claim 5, wherein: generally when the controller instructs the power switch to turn said one of the two or more anodes OFF, the controller also instructs the power switch to turn a next one of the two or more anodes ON.

7. A transmitter according to claim 4, wherein the controller instructs the power switch to sequentially turn the respective anodes ON when the electron beam generally approaches the respective anodes.

8. A transmitter according to claim 4 wherein the controller provides the timing based on current flows detected in the anodes by the controller caused at least in part by the moving electron beam.

9. A transmitter according to claim 8, wherein the controller senses current in each anode and instructs the power switch to sequentially turn the anodes ON when the controller senses that the passing electron beam has induced a threshold current in one or more of the anodes physically associated with the respective anodes being turned ON.

10. A receiver to decode a signal from electromagnetic radiation, comprising:

a cathode emitting electrons;

two or more anodes arranged sequentially downstream of the electrons emitted by the cathode;

a power source operationally associated with a power switch to provide power to selected ones of the two or more anodes based on positions of the electrons relative to the selected anodes;

at least one ultra-small resonant structure downstream of the two or more anodes and located proximate the electron beam whereby the resonant structures couple the electromagnetic radiation and affect either the direction or speed of the electron beam based on a content of the signal.

11. A receiver according to claim 10, wherein:

the two or more anodes are physically spaced at generally evenly spaced.

12. A receiver according to claim 11, wherein:

power switch switches power to anodes farther downstream of the cathode for shorter durations than for anodes nearer the cathode.

13. A receiver according to claim 10, further including:

a controller to provide the power switch with a timing to turn power ON respectively to the two or more anodes.

14. A receiver according to claim 13, wherein the controller instructs the power switch to turn a respective one of the two or more anodes OFF when it senses a position of the electron beam relative to the one anode being turned OFF.

15. A receiver according to claim 14, wherein: generally when the controller instructs the power switch to turn said one of the two or more anodes OFF, the controller also instructs the power switch to turn a next one of the two or more anodes ON.

16. A receiver according to claim 13, wherein the controller instructs the power switch to sequentially turn the respective anodes ON when the electron beam generally approaches the respective anodes.

17. A receiver according to claim 13 wherein the controller provides the timing based on current flows detected in the anodes by the controller caused at least in part by the moving electron beam.

18. A receiver according to claim 17, wherein the controller senses current in each anode and instructs the power switch to sequentially turn the anodes ON when the controller senses that the passing electron beam has induced a threshold current in one or more of the anodes physically associated with the respective anodes being turned ON.

19. A method, comprising the steps of:

providing a cathode to emit a pulse of electrons;

directing the electrons past a sequence of anodes;

powering the anodes in sequence as the pulse of electrons approaches the powered anodes;

providing at least one ultra-small resonant structure;

passing the pulse of electrons proximate the ultra-small resonant structure to couple energy between the pulse of electrons and the ultra-small resonant structure.

20. A method according to claim 19, wherein the energy is coupled from the pulse of electrons to the ultra-small resonant structure.

21. A method according to claim 20, wherein the energy is couple from the ultra-small resonant structure to the pulse of electrons.

* * * * *